United States Patent [19]

Bance

[11] 4,183,190

[45] Jan. 15, 1980

[54] SPACE FRAME CONSTRUCTION SYSTEM

[75] Inventor: Jean A. Bance, North Chicago, Ill.

[73] Assignee: Roper Corporation, Kankakee, Ill.

[21] Appl. No.: 901,575

[22] Filed: May 1, 1978

[51] Int. Cl.[2] ..... E04C 3/02

[52] U.S. Cl. ..... 52/648

[58] Field of Search ..... 52/81, 648; 138/114, 138/115; 285/131, 133 R

[56] References Cited

U.S. PATENT DOCUMENTS

| | | | |
|---|---|---|---|
| 3,110,754 | 11/1963 | Witort et al. | 138/115 |
| 3,789,562 | 2/1974 | Chicchis et al. | 52/648 |
| 4,027,449 | 6/1977 | Cilvetti | 52/648 |

FOREIGN PATENT DOCUMENTS

| | | | |
|---|---|---|---|
| 58807 | 11/1967 | German Democratic Rep. | 52/81 |

*Primary Examiner*—James L. Ridgill, Jr.

*Attorney, Agent, or Firm*—C. Frederick Leydig; Richard L. Voit; David J. Richter

[57] ABSTRACT

A tube and ball truss system for making a structural lattice which includes a plurality of hollow metal balls spaced in a three-dimensional array, each ball having a set of radial through-openings as well as an access opening on one side, adjacent ones of the balls being interconnected by metal tubes having an outer cylindrical wall and a central axially extending core joined by integral webs, the ends of the core having axially tapped holes engageable by clamping bolts extending through the through-openings in the balls. The ball surface is locally flattened to form land surfaces surrounding the through-openings for flat seating of the end surfaces of the tubes; indeed, the land surfaces are recessed to provide shallow socketed engagement and precise alignment with the ends of the tubes.

7 Claims, 15 Drawing Figures

SPACE FRAME CONSTRUCTION SYSTEM

Structural engineers have long been intrigued with the inherently clean design of a tube-and-ball three-dimensional truss array. A recent example of such array is shown in the Gugliotta U.S. Pat. No. 3,882,650 which employs hollow metal balls spaced from one another and interconnected by tubes. Extending through each of the tubes is a rod having threaded ends which project into the ball, held captive by nuts. While this provides the sought-after appearance, the Gugliotta system is highly inefficient from a structural point of view. In a three-dimensional array of this sort it is inherent that some of the tubes are in compression while others are in tension. When it comes to resisting tensile forces, the entire load must be borne by the central rod and the tube is completely useless and redundant. Conversely, when compressive forces are to be resisted, all of the compression is borne by the tube and the rod becomes useless and redundant. Thus there is a duplication of material in the system. Moreover, the rod and tube act constantly in opposition to one another, with the one stressing the other even in the absence of any externally applied load.

Apart from the inefficient use of material, the Gugliotta system has assembly complications, with each tube assembly consisting of no less than six parts which must be strung together in proper relation, which, in view of the number of tubes, makes the process more difficult and time consuming than need be. Also, the threaded ends of the rods, projecting unevenly into the space within the ball, make it difficult and sometimes impossible to insert a turning tool, either initially or for purposes of retightening after the truss system has been in use.

Another branch of the structural art has to do with partition systems, of which Jones U.S. Pat. No. 3,513,606 might be considered representative. In the Jones system use is made of square extrusions, grooved for reception of wallboard, which are supported, at their ends, on the walls of a box of rectangular shape. It will suffice to say that the needs of a partition system and of a truss system, including level of stress, are sufficiently different so that the two branches of the structural art have developed separately.

It is an object of the present invention, accordingly, to provide a three-dimensional truss system for supporting roof structure and the like which is formed of tubes and balls but which has a high degree of structural integrity and structural efficiency. It is a related object to provide a truss system of the tube-and-ball type in which each tube, upon application of external loading, is totally in tension or compression. It is thus an object to provide a tube-and-ball system in which all of the material forming a tube is uniformly utilized and uniformly stressed, thereby achieving for the system an exceedingly high strength-to-weight ratio.

It is another object of the present invention to provide a tube-and-ball system which is not only structurally safe but which is integrated and attractive in appearance, with the tubes being precisely positioned and socketed with respect to the engaged balls so that the crack separating the two is almost imperceptible and creating a joint which is sealed weather tight.

It is yet another object of the invention to provide a tube-and-ball truss system which is highly economical, both in its employment of structural material and in the time and effort required for assembly. Erection requires only the entry of the end of the tube into a shallow receiving socket and insertion and tightening of a bolt at each end, the space within the ball remaining open and uncluttered for easy entry and manipulation of a power driven socket wrench or equivalent turning tool. The size of the ball may be minimized.

In this connection it is an object to provide a tube and ball truss system in which the tubes may be economically cut, flush at the ends, to standard length, with any camber or arching of the structure being achieved by the sandwiching of washers to achieve a slight increase in the effective length of the tubes in upper position.

Other objects and advantages of the invention will become apparent upon reading the attached detailed description in which:

FIG. 1 is a plan view of a portion of a tube-and-ball lattice characteristic of the present invention.

Figures 9, 9A, 10, 10A:
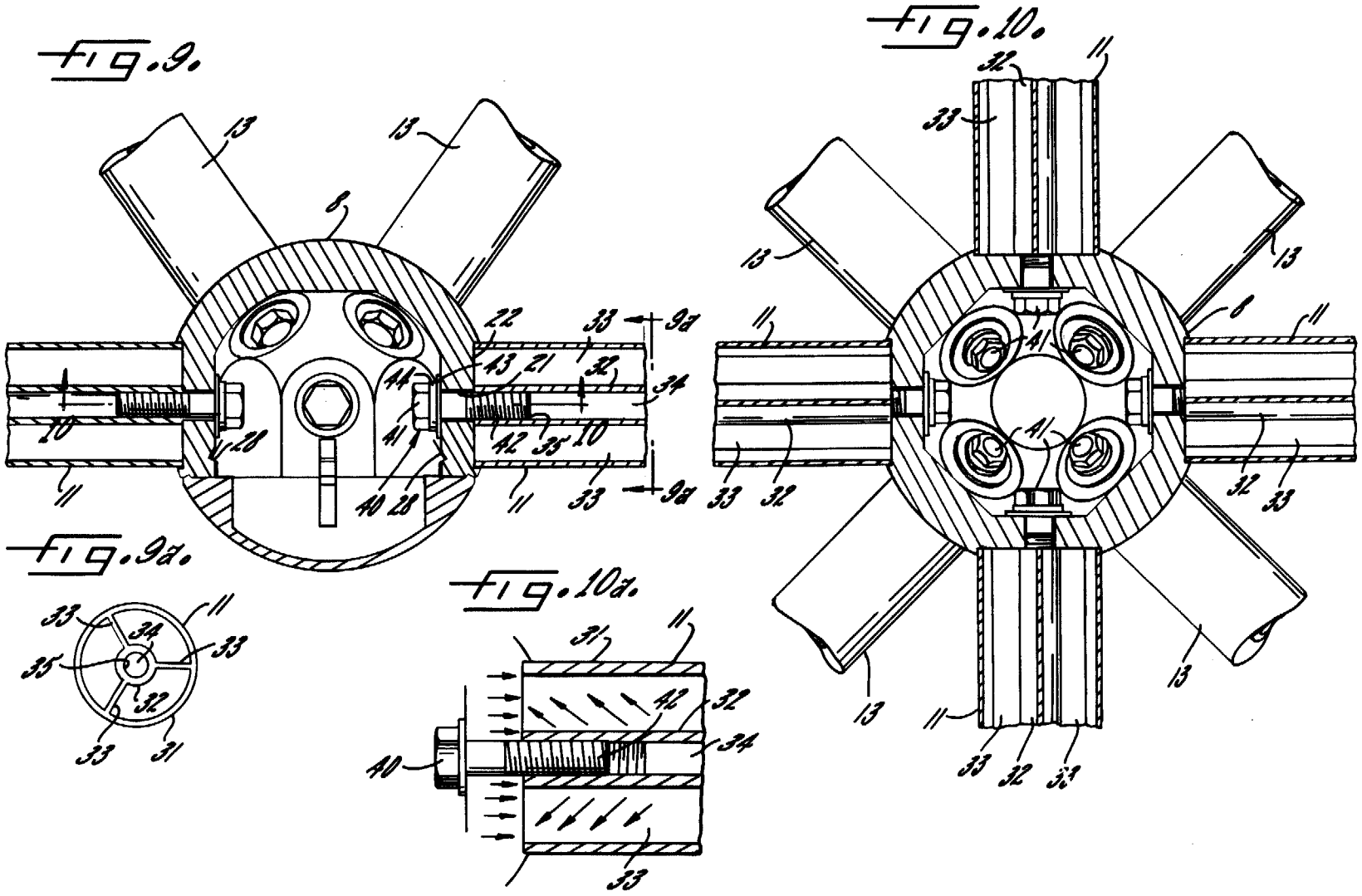
FIG. 9 is a vertical section taken through an assembled ball as, for example, along line 9—9 in FIG. 1.

FIG. **9*a* shows the tube cross section looking along line 9*a*—9*a* in FIG. 9**.

FIG. 10 is a section at right angles to FIG. 9 and taken along line 10—10 in the latter figure.

FIG. **10*a* is a fragmentary view based upon FIG. 9** and showing the transmission of stress from the core to the wall of the tube.

Figures 4, 5, 6, 7, 8, 11:
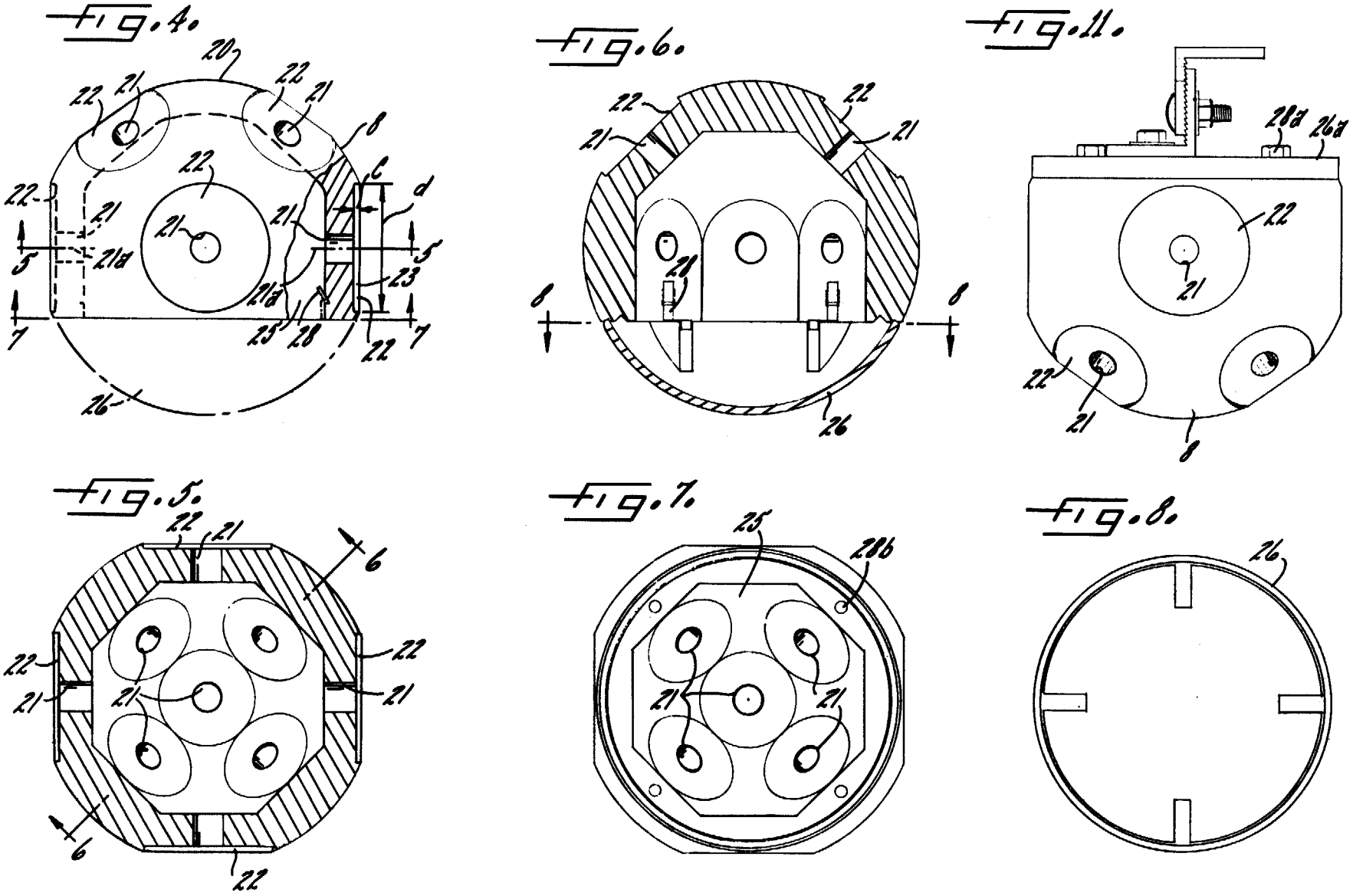
FIG. 4 is an elevational view of a typical ball in partial section.
FIG. 5 is a horizontal section taken along line 5—5 of FIG. 4.
FIG. 6 is a vertical section taken along line 6—6 of FIG. 5.
FIG. 7 shows the ball viewed from the underside, along line 7—7 in FIG. 4.
FIG. 8 is a plan view of the cover looking along line 8—8 in FIG. 4.

FIG. 11 is a view similar to FIG. 6 but showing a ball employed in the upper position enclosed by a flat plate.

Figures 3, 12, 12A:
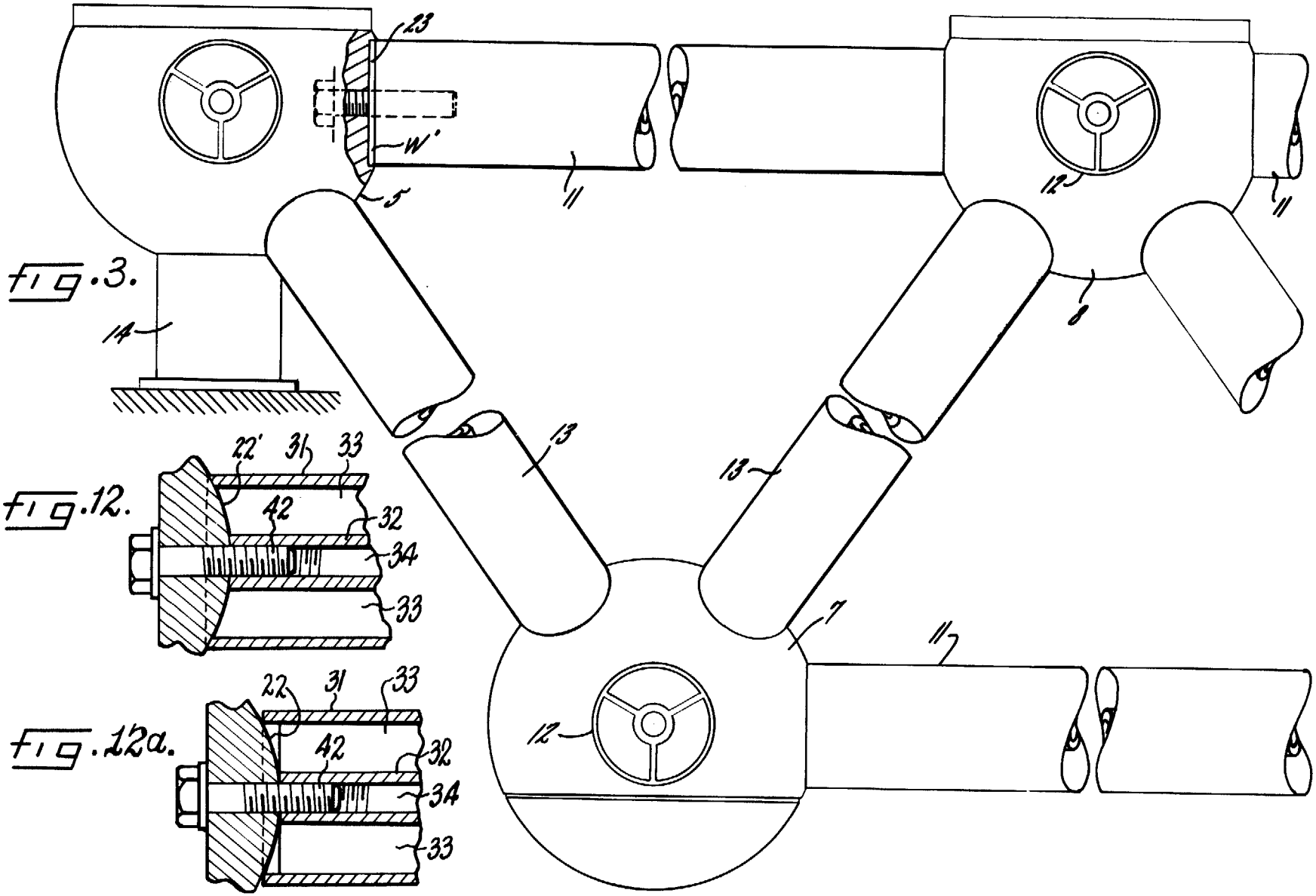
FIG. 3 is a detailed elevational view, in partial section, taken along line 3—3 in FIG. 1.

FIGS. 12 and **12*a*** show forms of relief at the tube ends.

While the invention has been disclosed in connection with a preferred embodiment, it will be understood that there is no intention to limit the invention to the particular embodiment shown but it is intended, on the contrary, to cover the various alternative and equivalent constructions included within the spirit and scope of the appended claims.

Figure 2A:
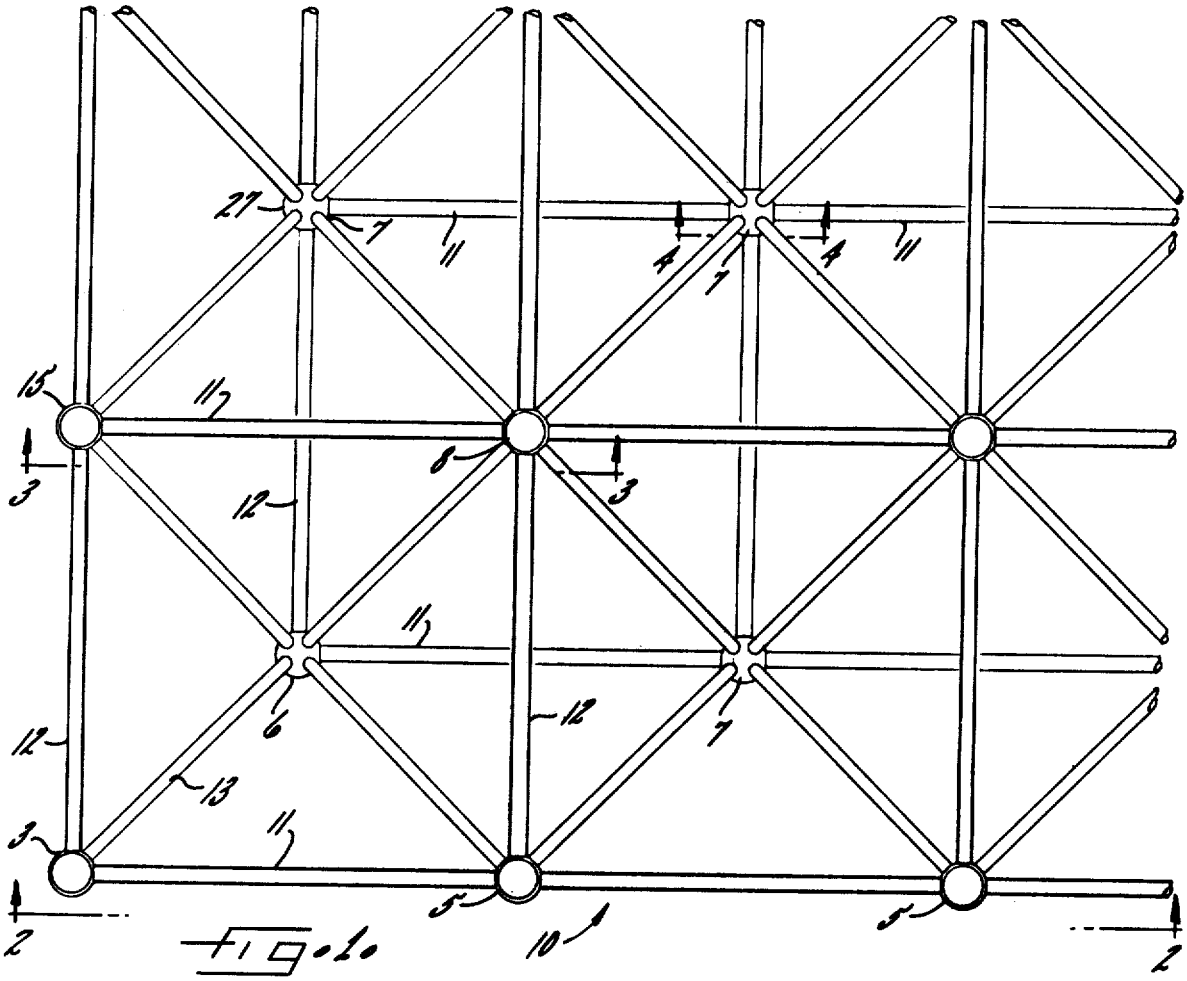
FIG. 2 is a fragmentary elevational view looking along line 2—2 of FIG. 1.
Figure 2B:
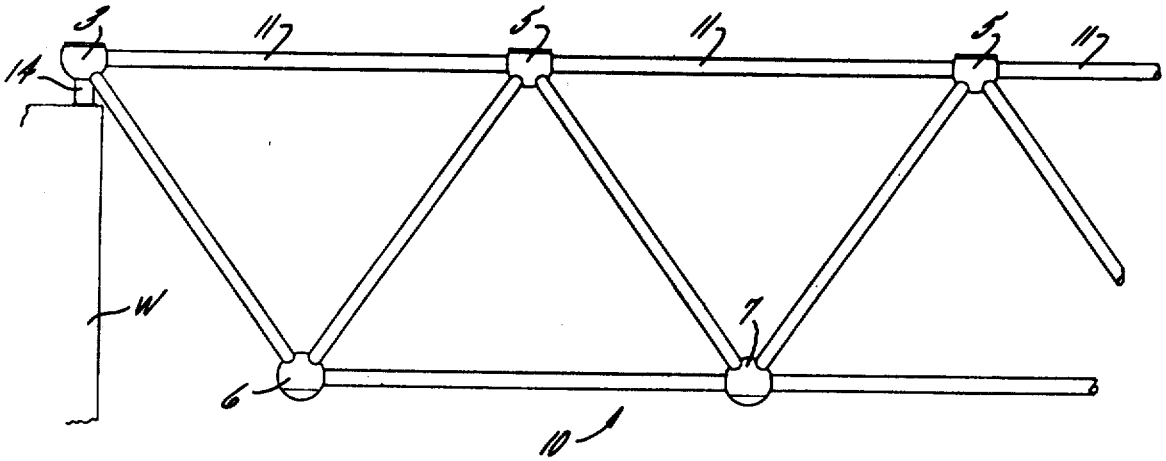

Turning now to the drawings there is disclosed in FIGS. 1 and 2 a tube and ball truss system consisting of a plurality of hollow metal balls designated at 3, 5, 6, 7 and 8 arranged in an upper level U and at a lower level L, the numeral indicating the total number of junctions occurring at the particular ball. Interconnecting the balls are tubular elements 11, 12 horizontally arranged at right angles to one another plus angled tubular elements 13. The elements 11, 12, 13, taken together, form a lattice defining interfitting modules of pyramidal shape. The lattice may be considered a continuous truss, having vertical thickness, and extending in two horizontal directions. For supporting the lateral edges of the lattice the side balls 5, including the corner balls 3, overlap the side walls of the structure, one of which is shown at W (FIG. 2). Interposed below each is short length of tubing 14 which forms a pedestal so that the balls do not rest directly upon the wall. A portion of the lattice has been illustrated in enlarged, but foreshortened, form in FIG. 3.

However, to understand the details of the ball construction and the manner in which the balls receive the tubular elements, reference is next made to FIGS. 4–7. In carrying out the invention each ball has radial through-openings as well as an access opening, with each through-opening being surrounded by a flat circular land surface, the ends of the tubes being centered in abutting relation to the land surfaces. Thus referring to the typical ball 8 illustrated in FIG. 4, it includes an outer surface 20 having through-openings 21 which are angularly spaced from one another and each of which is surrounded by a circular land surface 22. Each land surface is perpendicular to the axis 21*A* of its associated radial opening.

In accordance with one of the aspects of the present invention each land surface is recessed, or countersunk, by an amount "c" and at a diameter "d" which just slightly exceeds the diameter of the tubular elements 11–13 thereby to form a shallow socket 23 for snug reception of the ends of the elements.

The lower side of the ball 8, as illustrated in FIG. 4, has an access opening 25 which occupies a minor portion of the ball area, such access opening being enclosed by a cap 26 having a spherical outer surface 27 which forms a smooth continuation of the surface 20 of the ball, the cap, or cover, being held in place on the ball by a set of detent springs 28.

Further in accordance with the invention each tube is in the form of an extrusion having an outer cylindrical wall and a central axially-extending core together with longitudinally continuous angularly spaced webs for supporting the core with respect to the wall, each tube terminating in parallel end surfaces in which the wall, core and web are flush with one another for flatly seating in socketed position on the land surfaces. Taking the tube 11 shown in FIGS. 9 and 9*a* as representative, it includes an outer cylindrical wall 31, a central axially-extending core 32, and a set of three integral, longitudinally continuous and angularly spaced webs 33. The core 32 is preferably extruded with a continuous axial bore 34 which requires only running in and out of a tapping tool corresponding to the bolt shank thickness to form an internal thread 35.

For joining the tubes to the ball in clamped and socketed engagement, bolts 40 are used, each bolt having a head 41 and a threaded shank 42 penetrating the associated through-opening 21 and each bolt being provided with a flat stress-distributing washer 43 as well as a lock washer 44. As shown, the bolt shank diameter is but a small fraction of the tube diameter.

When a tube, for example the tube 11, is clamped up by a bolt, quickly and easily done by a powered socket wrench inserted into the access opening 25, stress is applied to the webs as indicated by the vectors set forth in FIG. 10*a* so that the clamping force of the bolt is applied uniformly over the end face of the tube. Since the heads 41 of the clamping bolts are relatively shallow, they do not take up much room in the central space of the ball so that there is easy access to as many as eight or even nine bolts in the same ball through the spacious access opening.

As is well known to structural engineers, some of the tubular elements forming a lattice of the type described are in tension while others are, at the same time, in compression. It is one of the features of the present construction that the tubular elements, except for localized forces existing in the clamping region, are totally in tension or compression, but not both, with purely axial stress distributed substantially equally over the three elements, wall, core and web, which make up each of the tubes. Thus all of the tube material is fully utilized, making it possible, for a given maximum unit stress, to minimize the cross sectional area of the material in the tube and, consequently, the weight of the tube for a given diameter and length. Because of the cylindrical shape of the tube, compressive loading is evenly distributed about the axis tending to avoid buckling or column action. Thus the construction is to be distinguished from prior art constructions employing a central rod which functions exclusively in tension surrounded by a wall which functions exclusively in compression. The construction is to be also distinguished from extruded elements of non-circular or discontinuous cross section which are ill-adapted to the equalized distribution of severe compressive loading.

It is, moreover, one of the features of the invention that the joint between the ends of the tubular elements and the surface of the ball is exceedingly neat, being in the form of a hairline crack barely visible to the eye, creating a tight substantially waterproof joint, a joint which may be made absolutely leakproof, if desired, by the interposition of a thin layer of resilient gasketing material sandwiched between the end of the tubing and the land surface which it engages.

The present lattice system may be fabricated and assembled at exceedingly low cost. Extrusions, normally of structural aluminum, can be produced and cut to length to produce flush end surfaces at low "poundage" rates. The balls are easily made by a casting or forging process, with the recessed lands 22 being formed by spot facing with a milling cutter employing an indexed jig or fixture to insure concentricity and perpendicularity with respect to the axis of the through-opening. Preferably a combined drilling-milling tool is used to perform both drilling and spot facing, the same hollow spherical workpiece being easily and quickly produced in the six versions required in the illustrated system.

No drilling is required in the tubes since the central bore 34 is formed in the extruding process—all that is necessary for reception of the bolt is the running in and out of a tap, quickly accomplished in an automated set-up.

In assembly the end of the tubular element is automatically located in concentric relation by seating in a recess 23, following which the clamping bolt 40 may be simultaneously inserted in position while it is rotated by a powered socket head wrench or equivalent with assurance that the tapped opening will be in its aligned, receiving position. Thus the time wasted in prior constructions in finding a condition of alignment or starting the thread can be saved.

While it is one of the features of the present system that all of the tubular elements 11, 12, 13 may be economically cut to the same length, the present system nevertheless contemplates that the lattice may have arching camber in either one or both horizontal directions. This is achieved by the sandwiched interposition of a washer adjacent at least one of the ends of each upper tube 11, 12 to slightly increase the effective length of the tube. Such a washer is indicated at W' in FIG. 3, the washer being preferably sized to correspond in diameter to the tube, permitting the washer to be easily located in position by seating it in the bottom of a recess 23. As desired the washers may be employed only with the tubular elements 11 to secure arching in one direction or with the elements 11, 12 to secure arching in both directions, that is, to provide slight "doming" to counteract vertical loading.

For the purpose of securing ceiling structure to the balls in the upper layer U the domed cap 26 is replaced by a flat pedestal plate 26*a* (FIG. 11) which is held in place by means of a set of four machine screws 28*a* which engage suitable threaded holes 28*b*, spaced evenly about the access opening 25.

By reference to the land surface 22 as "flat," and the recess 23 as being "flat bottomed,", is meant simply that planar support is provided for flat engagement of the presented end of the tube, and the surface 22 need not, necessarily, be smoothly continuous over its area. Similarly, by referring to the land surface 22 as "circular" it is meant that the surface encircles the associated through-opening and the periphery of the surface need not, in practicing the invention, be precisely circular in a geometric sense, nor need it be recessed.

While it is one of the features of the invention in its preferred form that the land surfaces 22 are both flat and recessed, the invention in its broader aspect is not limited thereto and, if desired, the land surfaces may form a spherical continuation of the outwardly facing ball surface and the ends of each tube may be centrally relieved to a sufficient depth to accommodate the curvature of the engaged land surfaces to secure firm and continuous seating of the outer cylindrical wall of the tube thereon. Thus in the version illustrated in FIG. 12, the land surface, indicated at 22', is spherical, and the end of the tube 31 is centrally and spherically relieved so that it substantially conforms to the presented surface of the ball, providing "area" contact therewith. Alternatively, the end of the tube 31 may be cylindrically relieved to a shallow depth as shown in FIG. 12*a;* indeed, the core 32 of the tube may, if desired, fall slightly short of the ball surface for concentration of the bearing stress by the wall of the tube upon a relatively narrow circular line on the ball surface.

I claim as my invention:

1. A tube-and-ball truss system for making a structural lattice comprising, in combination, a plurality of hollow metal balls spaced from one another in a three-dimensional array, each ball having an outwardly facing surface extending over a major portion of its area with spaced radial through-openings therein as well as an access opening on one side occupying a minor portion of the ball area, the outwardly facing surface including flat circular land surfaces surrounding the respective through-openings, metal tubes extending straight and rigid between adjacent ones of the balls, the ends of the tubes being in abutting relation to the land surfaces on the balls and in respective alignment with the through-openings therein; the tubes each being in the form of an extrusion having a smoothly continuous outer cylindrical wall and a central axially extending core together with longitudinally continuous angularly spaced webs for supporting the core with respect to the wall, the wall, core and webs being integral; the ends of the core having axially tapped holes; and clamping bolts for securing the tubes to the engaged balls; the bolts having heads inside of the balls and having respective shanks of a diameter which is a small fraction of the outer wall of the tube diameter, the shanks penetrating the through-openings and being in threaded engagement with the respective tapped holes so that upon turning the bolt heads by a tool extended into the access opening the tubes are clamped in tightly abutting relation to the balls, the cores of the tubes being hollow, having a continuous axial bore substantially corresponding in dimension to the diameter of the bolt shanks so that use of a tapping tool suffices to prepare the tubes for snug threaded engagement with the respective bolts.

2. A tube-and-ball truss system for making a structural lattice comprising, in combination, a plurality of hollow metal balls spaced from one another in a three-dimensional array, each ball having an outwardly facing surface extending over a major portion of its area with spaced radial through-openings therein as well as an access opening on one side occupying a minor portion of the ball area; metal tubes extending straight and rigid between adjacent ones of the balls, the ends of the tubes being in abutting relation to the outwardly facing surfaces of the balls and in respective alignment with the through-openings therein; the tubes each being in the form of an extrusion having a smoothly continuous outer cylindrical wall and a central axially extending core together with longitudinally continuous angularly spaced webs for supporting the core with respect to the wall, the wall, core and webs being integral; the tubes terminating in parallel end surfaces in which the wall, core and web are all flush with one another, the ends of the core having axial tapped holes; the outwardly facing surface of the ball being locally flattened to form land surfaces surrounding the through-openings and arranged perpendicularly with respect to the axes thereof, the land surfaces being of such diameter as to provide flat seating for the flush end surfaces of the tubes; and clamping bolts for securing the tubes to the engaged balls, the bolts having heads inside of the balls and having respective shanks of a diameter which is a small fraction of the outer wall of the tube diameter, the shanks penetrating the through-openings and being in threaded engagement with the respective tapped holes so that upon turning the bolt heads by a tool extended into the access opening the tubes are clamped in tightly abutting relation to the balls, the cores of the tubes being hollow, having a continuous axial bore substantially corresponding in dimension to the diameter of the bolt shanks so that use of a tapping tool suffices to prepare the tubes for snug threaded engagement with the respective bolts.

3. The combination as claimed in claim 2 in which the lattice includes upper and lower tubes arranged substantially parallel to one another and of equal length, and at least one of the ends of each upper tube having a washer sandwiched thereagainst to slightly increase the effective length of the upper tubes with respect to the lower thereby to archingly camber the lattice.

4. A tube-and-ball truss system for making a structural lattice comprising, in combination, a plurality of hollow metal balls spaced from one another in a three-dimensional array, each ball having a spherical outwardly facing surface extending over a major portion of its area with spaced radial through-openings therein as well as an access opening on one side occupying a minor portion of the ball area; metal tubes extending straight and rigid between adjacent ones of the balls, the ends of the tubes being in abutting relation to the outwardly facing surfaces of the balls and in respectve alignment with the through-openings therein; the tubes each being in the form of an extrusion having a smoothly continuous outer cylindrical wall and a central axially extending core together with longitudinally continuous angularly spaced webs for supporting the core with respect to the wall, the wall, core and webs being integral; the tubes terminating in parallel end surfaces in which the wall, core and web are all flush with one another, the ends of the core having axially tapped holes; the outwardly facing surface of the ball being spot-faced concentrically with each through-opening to form a flat-bottomed recess having a diameter such as to provide shallow socketed engagement with the flush end surfaces of each tube; and clamping bolts for securing the tubes to the engaged balls, the bolts having heads inside of the balls and having respective shanks of a diameter which is a small fraction of the outer wall of the tube diameter, the shanks penetrating the through-openings and being in threaded engagement with the respective tapped openings so that upon turning the bolt heads by a tool extended into the access opening the tubes are clamped tightly in the respective recesses, the cores of the tubes being hollow, having a continuous axial bore substantially corresponding in dimension to the diameter of the bolt shanks so that use of a tapping tool suffices to prepare the tubes for snug threaded engagement with the respective bolts.

5. A tube-and-ball truss system for making a structural lattice comprising, in combination, a plurality of hollow metal balls spaced from one another in a three-dimensional array, each ball having an outwardly facing spherical surface extending over a major portion of its area with spaced radial through-openings therein as well as a spacious access opening on one side occupying a minor portion of the ball area, circular land surfaces surrounding the respective through-openings, metal tubes extending straight and rigid between adjacent ones of the balls, the tubes each having a smoothly continuous outer cylindrical wall and a central axially extending core continuously secured thereto, the ends of the core having axially tapped holes, and clamping bolts for securing the tubes to the engaged balls, the bolts having heads inside of the balls and having respective shanks of a diameter which is a small fraction of the outer wall of the tube diameter, the shanks penetrating the through-openings and being in threaded engagement with the respective tapped holes so that upon turning the bolt heads by a tool extended into the access opening the tubes are clamped in tightly abutting relation to the outwardly facing surfaces of the balls, the cores of the tubes being hollow, having a continuous axial bore substantially corresponding in dimension to the diameter of the bolt shanks so that use of a tapping tool suffices to prepare the tubes for snug threaded engagement with the respective bolts.

6. The combination as claimed in claim 5 in which the land surfaces form a spherical continuation of the outwardly facing spherical surface of each of the balls and in which the ends of each tube are centrally relieved to a sufficient depth to accommodate the curvature of the engaged land surfaces to secure firm and continuous seating of the outer cylindrical wall of the tube thereon.

7. The combination as claimed in claim 6 in which each relief is concavely spherical for conformingly mating with the engaged spherical surface on the ball.

* * * * *